US006171223B1

(12) United States Patent
Koivukunnas et al.

(10) Patent No.: US 6,171,223 B1
(45) Date of Patent: Jan. 9, 2001

(54) METHOD FOR MANUFACTURE OF A CALENDER ROLL PROVIDED WITH AN ELASTIC COATING AND CALENDER ROLL MANUFACTURED IN ACCORDANCE WITH THE METHOD

(75) Inventors: Pekka Koivukunnas, Järvenpää; Mika Viljanmaa, Espoo, both of (FI)

(73) Assignee: Valmet Corporation (FI)

( * ) Notice: Under 35 U.S.C. 154(b), the term of this patent shall be extended for 0 days.

(21) Appl. No.: 09/308,861

(22) PCT Filed: Oct. 14, 1998

(86) PCT No.: PCT/FI98/00799

§ 371 Date: May 26, 1999

§ 102(e) Date: May 26, 1999

(87) PCT Pub. No.: WO99/19565

PCT Pub. Date: Apr. 22, 1999

(30) Foreign Application Priority Data

Oct. 14, 1997 (FI) ..... 973952

(51) Int. Cl.[7] ..... B25F 5/02
(52) U.S. Cl. ..... 492/56; 492/49; 72/252.5
(58) Field of Search ..... 72/252.5; 492/43, 492/44, 46, 47, 49, 53, 56; 165/89, 90

(56) References Cited

U.S. PATENT DOCUMENTS

| | | | | |
|---|---|---|---|---|
| 125,787 | * | 4/1872 | Cable | 492/44 |
| 1,067,607 | * | 7/1913 | Holder | 492/44 |
| 5,292,298 | | 3/1994 | Scannell | 492/46 |
| 5,759,141 | | 6/1998 | Schmitz | 492/39 |
| 5,766,120 | | 6/1998 | Schmitz | 492/26 |

FOREIGN PATENT DOCUMENTS

| | | | |
|---|---|---|---|
| 279107 | 10/1914 | (DE) . | |
| 19533823 | 10/1996 | (DE) | F16C/13/00 |
| 19511595 | 4/1997 | (DE) | F16C/13/00 |
| 0735287 | 10/1996 | (EP) | F16C/13/00 |
| 0828029 | 3/1998 | (EP) | D21G/1/00 |
| 1036922 | 7/1966 | (GB) . | |

* cited by examiner

*Primary Examiner*—Rodney A. Butler
(74) *Attorney, Agent, or Firm*—Steinberg & Raskin, P.C.

(57) ABSTRACT

A method for manufacturing a calendar roll in which a continuous band of filler material is wound onto an axle until a desired diameter for the roll is obtained, and then an elastic coating is applied to an outermost surface of the band, i.e., the outermost layer of windings. An adhesive agent may be applied onto the band such that adjacent windings of the band adhere to one another during winding of the band onto the axle. Adjacent windings of the band in an uppermost layer of windings may be welded together to provide a foundation for the elastic coating. The calender roll includes an axle, a uniform and continuous band of filler material wound onto the axle to provide the roll with a desired diameter, and an elastic polymer coating arranged on an outermost layer of windings of the band on the axle.

19 Claims, 3 Drawing Sheets

METHOD FOR MANUFACTURE OF A CALENDER ROLL PROVIDED WITH AN ELASTIC COATING AND CALENDER ROLL MANUFACTURED IN ACCORDANCE WITH THE METHOD

FIELD OF THE INVENTION

The invention concerns a method for manufacture of a calender roll provided with an elastic coating, in which method the roll frame is composed of a continuous axle and of a filler material fitted onto the axle.

The invention also concerns a calender roll manufactured in accordance with the method, comprising a continuous roll axle, a filler material fitted onto the axle, which filler material, together with the axle, forms the roll frame, and an elastic polymer coating fitted onto the roll frame.

BACKGROUND OF THE INVENTION

A supercalender normally comprises a stack of rolls consisting of a number of rolls fitted one above the other, in which stack, between the upper roll and the lower roll in the calender, there are a number of intermediate rolls, which are alternatingly chilled rolls and soft-faced rolls. Earlier, as soft-faced rolls, almost exclusively so-called fibre rolls were used, which consisted of disks or rings of fibrous material fitted on the roll axle and pressed together axially by means of end pieces and end nuts so that the soft face of the roll consisted of said fibre disks. It was one drawback of such fibre rolls that the deflections and rigidities of said fibre rolls differed quite substantially from corresponding properties of the chilled rolls, because the frame of the fibre rolls is quite slender as compared with the chilled rolls. As second significant drawback was relatively rapid wear of the fibre rolls.

Development of rolls and roll coatings made it possible, in supercalenders, in stead of fibre rolls, to employ rolls provided with elastic coating, in particular with a polymer coating, as soft rolls. In such rolls, the thickness of the coating in relation to the roll diameter is quite little, in which case the roll frame can be made quite rigid. Thus, in particular when rolls with polymer faces are employed, the rolls can be constructed so that the rigidities and deflections of all of the intermediate rolls in the calender are substantially equal, or at least the differences in these properties from roll to roll are quite little. It is a second improvement in polymer-coated rolls, as compared with fibre rolls, that their service life is considerably longer, i.e. the intervals of replacement of rolls can be made considerably longer.

In conventional rolls with polymer coatings, a significant problem, however, consists of the relatively high weight of the rolls as compared with fibre rolls. Thus, these polymer-coated rolls of novel type cannot be used as such in renewals and modernizations of existing calenders in which fibre rolls were used as soft-faced rolls earlier. This comes simply from the fact that, in a calender which was originally designed so that fibre rolls are employed as intermediate rolls, the mechanical strength of the spindles and spindle nuts on whose support the rolls are suspended does not endure the increased weight resulting from the polymer-faced rolls. Thus, in modernizations of supercalenders, if it is desirable to employ polymer-coated rolls of new type, considerable changes and renewals must be carried out in the frame constructions of the calender and in the means of suspension of the rolls. Thus, it is an aim to be able to reduce the weight of the polymer-faced rolls employed in supercalenders substantially in order that such rolls, whose other properties are better than those of fibre rolls, could be used simply also in modernizations of supercalenders.

With respect to the prior art, reference is made to the U.S. Pat. No. 3,711,913, to the DE Patent 195 11 595 (corresponding to U.S. Pat. No. 5,766,120), to the published DE Patent Application 195 33 823 (corresponding to U.S. Pat. No. 5,759,141), and to the published EP Patent Application 735,287 (also corresponding to U.S. Pat. No. 5,766,120).

In said U.S. Patent, a method is described for conditioning of a fibre roll, in which method a worn or damaged fibre roll is machined to a measure smaller than its original diameter, after which a coating of a synthetic plastic material is fitted onto the roll, i.e. directly onto the fibre disks. With this procedure, the roll can be made suitable for a certain purpose of use, but the properties of a roll manufactured or conditioned in compliance with said method do not correspond to what is required from a modern polymer-faced calender roll. First, the rigidity of the roll is considerably lower than the rigidity of a tubular polymer roll, and further, since the coating has been fitted directly onto the fibre disks, the properties of resilience of the roll differ considerably from what is expected, for example, from a modern tubular polymer roll.

In the DE and EP publications referred to above, polymer-faced calender rolls are described which have been formed so that, in the roll, the axle of an existing fibre roll is used so that, onto the axle, in place of the filler material of the fibre roll, for example, disks made of aluminum cell material are fitted, in which disks at least a part of the walls of the cells are perpendicular to the roll axle. Then, onto these disks, an elastic polymer coating has been fitted. The roll formed in this way has quite good properties, in particular because the weight of the roll has become so low that it can be utilized easily in renewals of supercalenders, because the difference in weight of the roll as compared with a fibre roll is very little. It is a significant drawback of these rolls that, according to a first embodiment, the roll is manufactured by pressing loose disks between locking flanges, as is the case in traditional paper rolls, in which case it is very difficult to provide the desired rigidity. The rigidity is determined in accordance with the pre-stress of the axle and with the compression strength of the disks, as is the case in traditional paper rolls. In a second embodiment desribed in the cited prior-art publications, the support construction is composed of a plate of cellular construction which is wound as layers onto the axle. In the embodiment described in the publications, this procedure requires formation of joints in the longitudinal direction of the roll and bending of large plate-like pieces into correct shape, which requires high precision and care of manufacture. A further drawback is the high cost, which comes, besides from the above reasons, also from the technique of manufacture that has been used, which requires casting and machining of the disks. Also, depending on the purpose of use and on the diameter of the roll, the disks must always be designed anew, and a number of different cast models must be prepared for different rolls. In said publications, as a further alternative embodiment, forming of disks has been suggested out of a material that contains reinforcement fibres, such as epoxy reinforced with fibreglass, carbon fibres, aramide fibres, or equivalent. Such solutions are, of course, usable in themselves, and they provide a roll of quite low-weight construction, but the problem is an even higher cost.

The object of the present invention is to provide a novel method for manufacture of a calender roll provided with an elastic coating as well as a calender roll manufactured in accordance with the method, which method and roll do not involve the drawbacks involved in the prior art and by means of which method and roll, further, a significant improvement is achieved over the prior art. In view of achieving the objectives of the invention, the method in accordance with the invention is mainly characterized in that the filler material is made of a continuous profile band, which is wound onto the axle as the desired number of windings in order to produce the desired roll diameter, in which connection an elastic coating is formed onto the cylindrical outer face of the filler material.

OBJECTS AND SUMMARY OF THE INVENTION

On the other hand, the calender roll in accordance with the invention is mainly characterized in that the filler material has been made of a uniform and continuous profile band, which has been wound onto the axle as the desired number of windings in order to produce the desired roll diameter.

The invention provides significant advantages over the prior art, and of the advantages obtained by means of the invention, for example, the following can be stated. First, the manufacture of the roll in accordance with the invention is very easy. Owing to this easy mode of manufacture and, also, of the materials employed, the cost of manufacture of the roll is essentially low, as compared with the prior art described above. The roll produced in accordance with the present invention is of low-weight construction, owing to which it can be employed readily in modernizations of supercalenders as substitution for earlier fibre rolls. The properties of operation of the roll, however, meet the requirements imposed on a modern polymer-coated tubular roll. Owing to the winding technique that is employed, the rigidity of the roll can be made fully as desired, and in particular if the layers that are wound are glued or welded together, the construction of the roll becomes highly rigid. Further, since the roll has been formed by means of the winding technique and since the intermediate layers have been locked from their ends directly on the roll axle or on a lower intermediate layer, no locking flanges are needed, but the roll frame itself forms a struture that remains in its position on the axle, and the end flanges, if any, operate just as a piece for the supply of a cooling/heating medium to the roll frame. This is why the end pieces of the roll are just covering flanges and fixed to the profile bands only, and not at all fixed to the axle. The firrer advantages and characteristic features of the invention will come out from the following detailed description of the invention.

BRIEF DESCRIPTION OF THE DRAWINGS

In the following, the method in accordance with the invention and the calender roll manufactured in compliance with the method will be described in more detail with reference to the figures in the accompanying drawing.

DETAILED DESCRIPTION OF THE PREFERRED EMBODIMENTS

Figure 1:
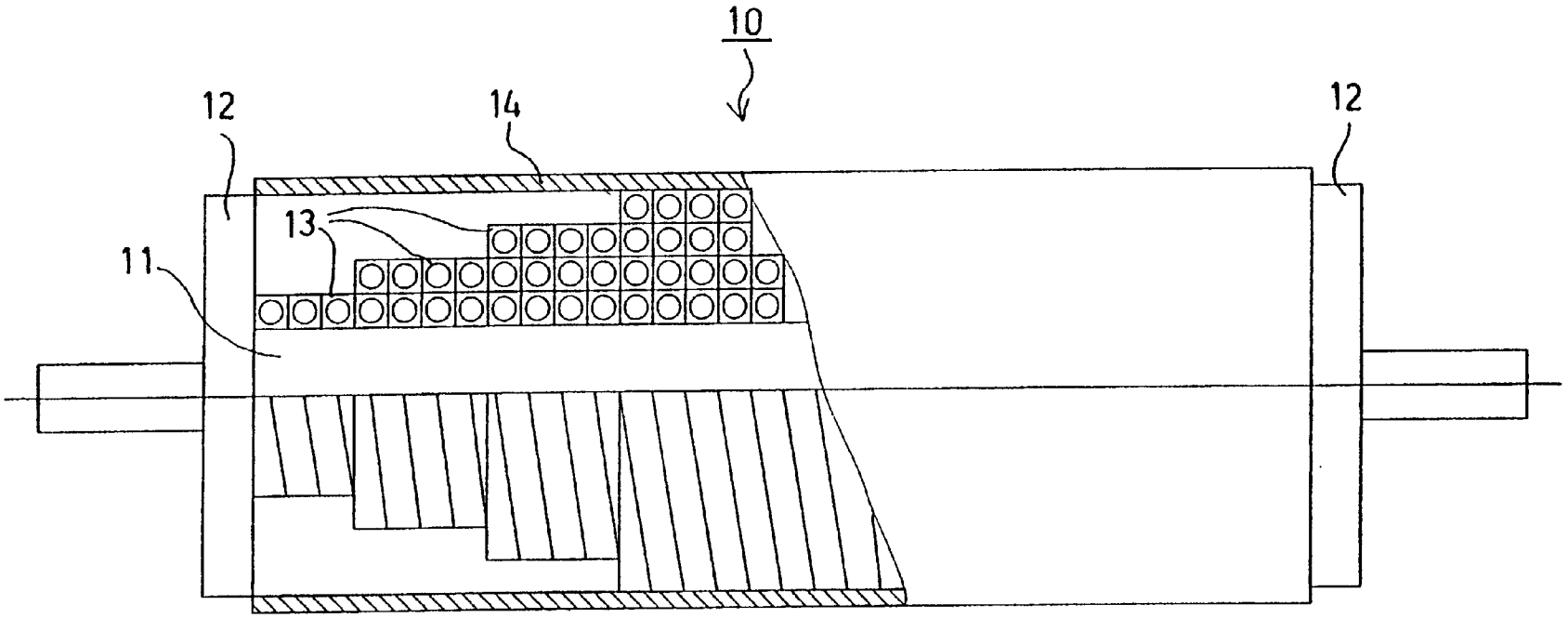
FIG. 1 is a schematic illustration partly in section of a roll in accordance with the invention.

In FIG. 1, the roll is denoted generally with the reference numeral 10. The roll 10 has preferably been formed so that, in the manufacture of the roll 10, an existing fibre roll has been used, from which the fibre disks have been removed. Thus, as the starting point of the novel method, the axle of such a fibre roll has been adopted, which axle is denoted with the reference numeral 11 in the figure. This axle 11 has been mounted in a winding machine, and in the winding machine the desired number of layers of a profile band 13 have been wound onto the axle 11, one layer onto the other, so that said layers of profile band 13 form a filler material onto the axle 11, which filler material, together with the axle 11, forms the roll frame. Then, onto this roll frame, a resilient polymer coating 14 has been applied fully similarly to the way in which it is currently applied onto tubular polymer rolls. The reference numeral 12 denotes the end pieces of the rolls 10, taken as such from the old fibre roll.

The profile band 13 is favourably made of aluminum material, because this material is already in itself of low weight and because, out of said material, a band of the desired profile can be prepared by extruding. The band can also be made, for example, by rolling, but an extrusion process is preferable exactly because by its means, for example, a hollow profile of the sort illustrated in the figure in the drawing can be obtained, in which case the filler material of the roll becomes of even lower weight. By varying the shape of the profile, it is possible to optimize the amount of material and the amount of air in the filler material, by which means it is, in a simple way, possible to affect the weight of the filler material and of the whole roll. The filler material or, in fact, the weight of the filler material must be optimized so that it endures all the loads applied to the roll 10 but does not have any extra weight. The mass of the filler material and the additional rigidity of the roll frame obtained by means of the filler material are preferably optimized so that the natural deflection of the roll arising from its own weight is substantially equal to the corresponding deflections of the other rolls in the calender. By means of this system, it is very easy, by slightly altering the extrusion tool, to change the material-to-air ratio of the filler material without any machining operations. The filler material made of the profile band 13 is particularly advantageous also because the diameter of the roll frame can be regulated by varying the number of winding layers of the profile band 13 or by varying the height of the profile to be wound. Thus, all different dimensions of rolls can be accomplished by means of one and the same profile, in which case manufacture of the rolls is highly advantageous.

A roll manufactured in the way in accordance with the invention already becomes very robust in itself and endures loading very well. The load holding capacity and the robustness can be increased substantially, for example, so that, in connection with the winding, the profile band is immersed in an adhesive agent, in particular epoxy, whereby the wound profile band is glued into a solid "package" and forms a robust roll frame. It is also possible to think that the layers of profile band, or at least the topmost layer, are/is welded, in which case the layer forms a good foundation for the roll coating 14. It is a significant additional property of the roll in accordance with the invention that, as the profile is hollow and tubular in the way illustrated in the figure, some medium can be passed to flow inside the profile, such as air or water, which medium transfers heat and equalizes differences in temperature in the roll. In particular in cases in which there is an even number of winding layers, the heat transfer medium runs back and forth from end to end in the roll, in which case the temperature profile of the roll becomes highly uniform.

Figures 2, 2A:
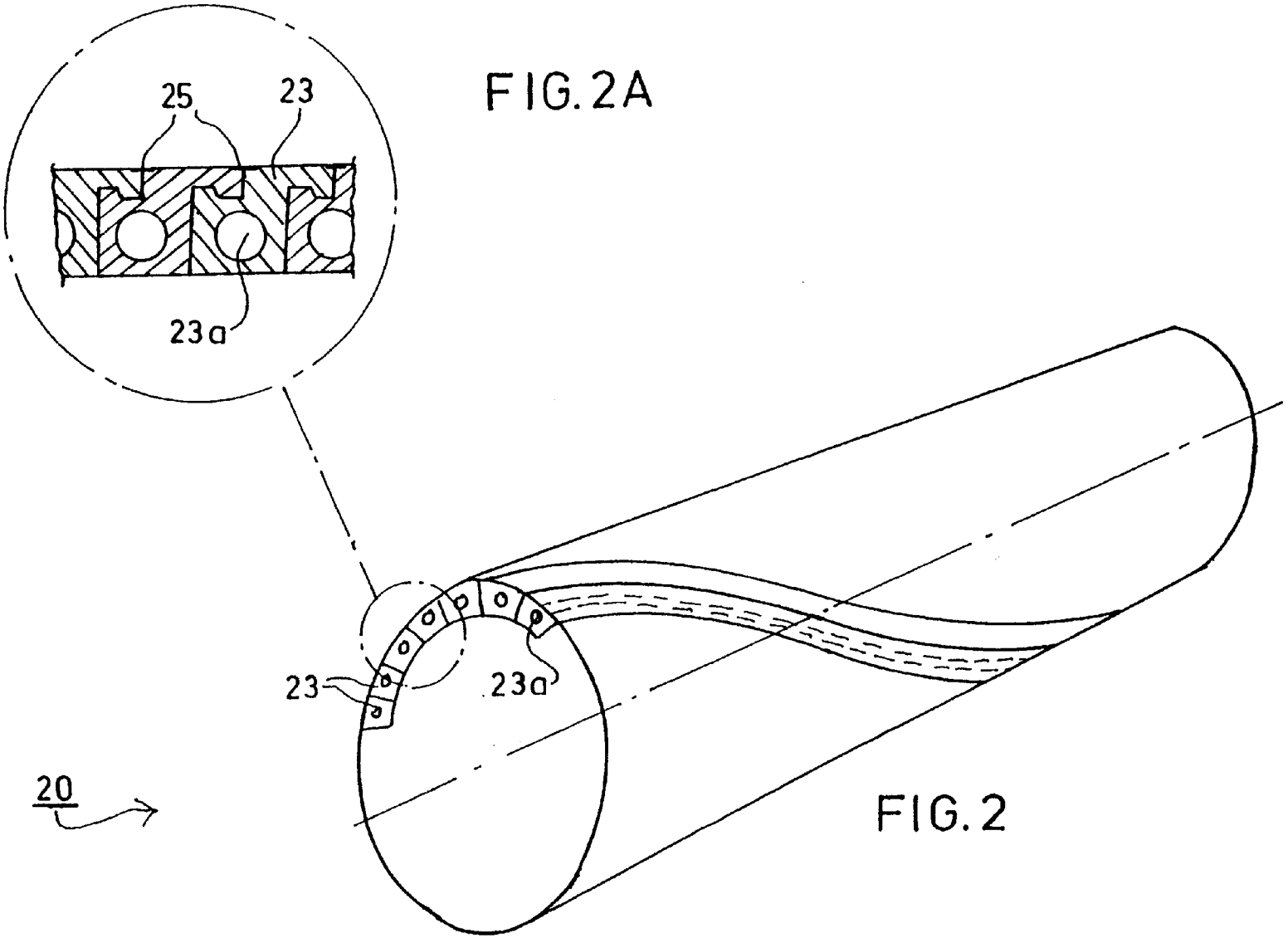
FIG. 2 is a schematic illustration of an embodiment of a roll in accordance with the invention.
FIG. 2A is a detail from FIG. 2.
Figure 3:
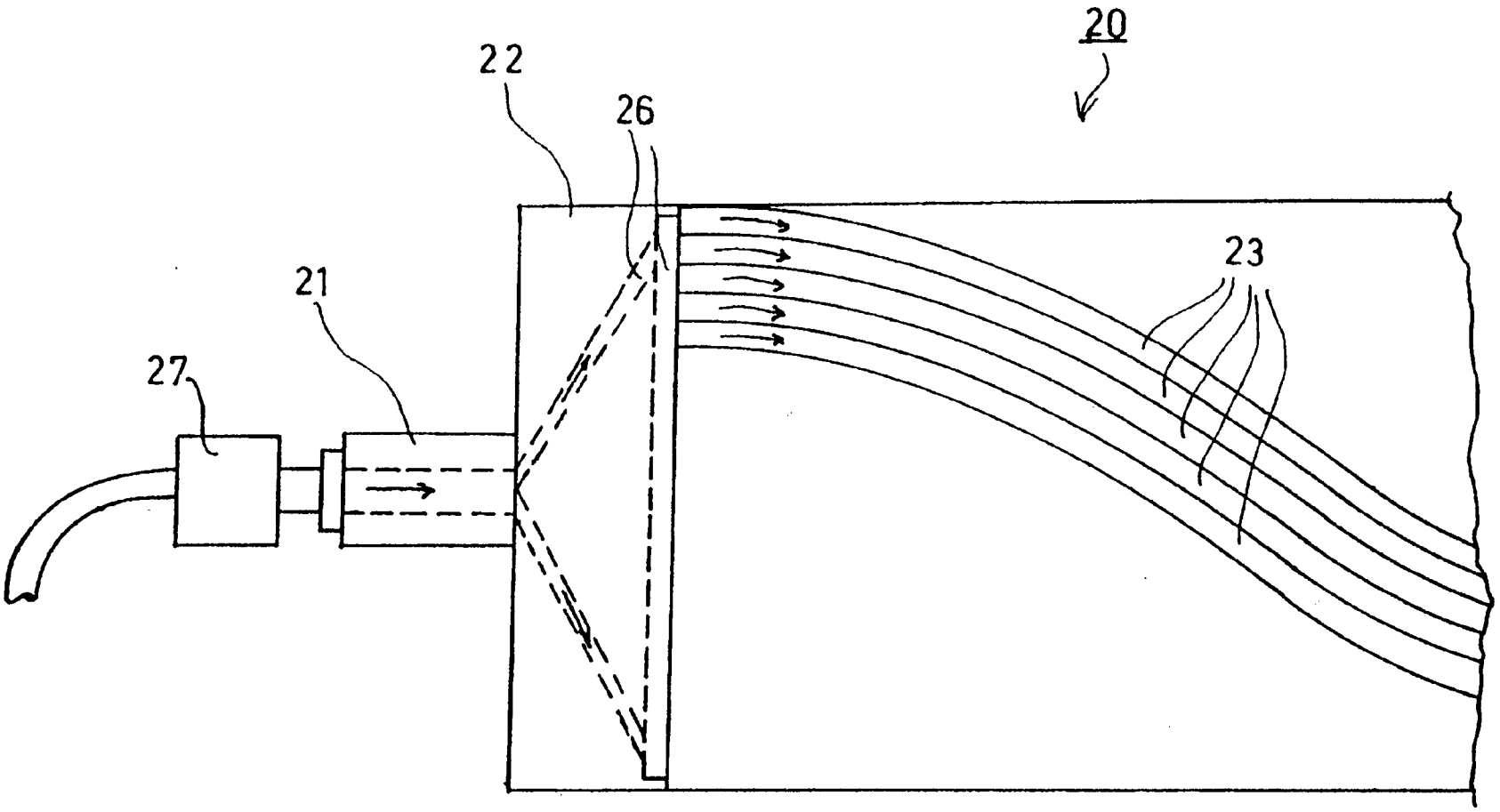
FIG. 3 shows a further embodiment in a roll as shown in FIG. 2.

In FIGS. 2 . . . 3 in the drawing, an additional embodiment of a roll is shown, which is denoted generally with the reference numeral 20. FIGS. 2 and 3 illustrate the roll without a roll coating, which coating is, however, also supposed to be used in the solution in accordance with these figures. FIG. 2A shows a detail from FIG. 2. The embodiment shown in FIGS. 2 and 3 differs from FIG. 1 in particular in the respect that, in the embodiment that is now being discussed, the profile bands 23 have been wound as filler material onto the roll or at least as the outer layer of the filler material, substantially less steeply than in the embodiment shown in FIG. 1. As a matter of fact, in the embodiment shown in FIGS. 2 and 3, the direction of the threading of winding differs from the axial direction of the roll to a substantially lower extent than it differs from the direction transverse to said axial direction. By means of this solution, attempts have been made to improve and to facilitate the introduction of the heat transfer medium into the ducts 23*a* in the profile band 23 and the circulation of said heat transfer medium in the ducts. Circulation of such a heat transfer medium in the ducts 23*a* in the profile band is advantageous, for example, when it is desirable to use a heat transfer medium for cooling of the roll and in particular of the roll coating, because an excessive heating of the coating makes the wear quicker and may result in damage to the coating in a very short time. As was already stated earlier, it is preferable to make the profile band 23 out of aluminum material by extrusion, because in such a case the profile band can be provided with the desired shape very easily.

As a preferred solution of the shape of the profile band, in FIG. 2A a shape of the profile band is illustrated owing to which the profile band is "self-locking" so that adjacent profile bands are attached to one another because of their shape. In the attaching, gluing can also be employed as an aid, and, as an additional alternative, it is further possible to employ friction welding of the profile band at least in the outermost layer of the filler material. In such a case, the manufacture of the roll could be made automatic so that friction welding is carried out at the joints 25 between adjacent profile bands 23 in connection with the winding. As was already stated above, in the solution of FIGS. 2 and 3, the profile band 23 has been wound as very gently inclined at least in the outermost layer of the filler material. It is not advantageous the arrange the profile bands 23 fully axially, because such an axial alignment might cause vibration in the roll during operation and also a barring pattern in the paper. Such drawbacks can be avoided even with a slight spiral form of the profile band.

FIG. 3 is a schematic illustration of a solution of how a heat transfer medium can be passed into the ducts 23*a* in the profile bands 23. This has been accomplished simply so that, into the roll 20 axle 21, or at least into the end of the axle, a duct or bore has been formed for the heat transfer medium, and similarly, into the end piece 22 of the roll, a necessary system of ducts 26 has been formed, which communicates with the bore that has been formed into the axle 21, on one hand, and with the ducts 23*a* in the profile bands 23, on the other hand. Further, to the end of the axle 21, a water couping 27 or equivalent has been connected, by whose means the heat transfer medium is passed into the roll.

The shape of the profile band 13 does not necessarily have to be a hollow profile similar to that shown in the figures, but, as the profile, it is also possible to employ an open profile, for example an I-section profile. Such a profile is very easy to produce, besides by means of extrusion, also by rolling. When such an open profile is wound onto the axle side by side, between the profiles, ducts remain which are closed ducts. In particular in cases in which the medium that is circulated in the ducts is air, such an open profile operates very well, in particular in cases in which, in connection with winding, gluing is also employed, as was already explained earlier. As the preferred materal alternative for a profile band, aluminum material can probably be considered, even if other materials can also be considered to be employed in the roll. The material must, however, be such that, out of the material, such a profile band can be formed readily in which, at least in connection with winding, ducts can be formed in the filler material, as was described above. Of materials that can be thought of, it is possible to mention, for example, different polymer materials, even though a limiting factor in their case is a cost substantially higher than the cost of aluminum.

It is a further feature of the roll in accordance with the invention that, in cases in which a heat transfer medium is made to flow in the ducts in the filler material, the heat transfer medidn can be utilized for heating of the roll at least during the starting stage of the calender, in which case said start-up stage can be made shorter. Further, it is evident that the heat transfer medium can also be used for cooling the roll.

Above, the invention has been described by way of example with reference to the figure in tihe accompanying drawing. The invention is, however, not confined to the exemplifying embodiment illustrated in the figure alone, but different alternative embodiments of the invention may show variation within the scope of the inventive idea defined in the accompanying patent claims.

What is claimed is:

1. A calender roll comprising an axle, a uniform and continuous band of filler material wound onto said axle for providing the calender roll with a desired diameter, an elastic polymer coating arranged over an outermost layer of windings of said band on said axle;

wherein said band defines at least one duct extending from one axially end of the roll to the other end of the roll.

2. The calender roll of claim 1, wherein said at least one duct comprises a continuous spiral shaped duct extending between ends of the roll.

3. The calender roll of claim 1, wherein said band includes a hollow interior space forming a closed duct extending over a length of said band.

4. The calender roll of claim 1, wherein the outermost layer of windings of said band is oriented such that a direction of the orientation differs from an axal direction of the roll less than the direction of the orientation differs from a direction transverse to the axial direction.

5. The calender roll of claim 1, wherein the outermost layer of windings of said band include at least one duct structured and arranged to receive a fluid heat transfer medium.

6. The calender roll of claim 1, wherein said band is made from extruded aluminum.

7. The calender roll of claim 1, wherein said band is made from rolled aluminum.

8. The calender roll of claim 1, further comprising an adhesive for attaching adjacent windings of said band together.

9. The calendar roll of claim 1, wherein adjacent windings in the outermost layer of windings are welded together.

10. The calender roll of claim 1, further comprising end pieces arranged at ends of the roll, said band being wound between said end pieces.

11. A method for manufacturing a calendar roll, comprising the steps of:

winding a continuous band of filler material onto an axle until a desired diameter for the roll is obtained, applying an elastic coating over an outermost layer of windings of the band, forming at least one spiral-shaped duct extending between axial ends of the roll and between adjacent layers of winding of the band during winding of the band onto the axle.

12. The method of claim 11, further comprising the step of:

forming the band by extrusion.

13. The method of claim 11, further comprising the step of:

forming the band by rolling.

14. The method of claim 11, further comprising the step of:

forming the band from aluminum.

15. The method of claim 11, further comprising the step of:

constructing the band such that adjacent windings mate with one another.

16. The method of claim 11, further comprising the step of:

applying an adhesive agent onto the band such that adjacent windings of the band adhere to one another during winding of the band onto the axle.

17. The method of claim 18, further comprising the step of:

welding adjacent windings of the band in an uppermost layer of windings together.

18. A method for manufacturing a calender roll, comprising the steps of:

winding a continuous band of filler material onto an axle until a desired diameter for the roll is obtained, applying an elastic coating over an outermost layer of windings of the band, arranging a duct in the band oriented in a direction parallel to a longitudinal direction of the band.

19. A method for manufacturing a calender roll, comprising the steps of:

winding a continuous band of filler material onto an axle until a desired diameter for the roll is obtained, applying an elastic coating over an outermost layer of windings of the band, providing the band with an open profile such that a plurality of ducts are formed during the winding of the band onto the axle.

* * * * *